US011108196B2

(12) United States Patent
Hsu et al.

(10) Patent No.: US 11,108,196 B2
(45) Date of Patent: Aug. 31, 2021

(54) CABLE CONNECTOR ASSEMBLY AND ASSEMBLING METHOD OF THE SAME

(71) Applicants: New Ocean Precision Component (Jiangxi) Co., Ltd., Yichun (CN); FOXCONN INTERCONNECT TECHNOLOGY LIMITED, Grand Cayman (KY)

(72) Inventors: Yang-Tsun Hsu, New Taipei (TW); Xu-Xiang Qi, Kunshan (CN); Jun-Cheng Lin, New Taipei (TW)

(73) Assignees: New Ocean Precision Component (Jiangxi) Co., Ltd., Yichun (CN); FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 16/745,381

(22) Filed: Jan. 17, 2020

(65) Prior Publication Data

US 2020/0244013 A1 Jul. 30, 2020

(30) Foreign Application Priority Data

Jan. 28, 2019 (CN) ..... 201910081594.6

(51) Int. Cl.

| | |
|---|---|
| ***H01R 13/659*** | (2011.01) |
| ***H01R 13/6593*** | (2011.01) |
| ***H01R 43/20*** | (2006.01) |
| ***H01R 13/504*** | (2006.01) |

(52) U.S. Cl.
CPC ..... *H01R 13/6593* (2013.01); *H01R 13/504* (2013.01); *H01R 43/20* (2013.01)

(58) Field of Classification Search
CPC ..... H01R 13/6593; H01R 13/6592
See application file for complete search history.

(56) References Cited

U.S. PATENT DOCUMENTS

| | | | | |
|---|---|---|---|---|
| 6,530,789 | B2 * | 3/2003 | Konda | H01R 9/0518 439/98 |
| 9,515,439 | B2 | 12/2016 | Ng et al. | |
| 2017/0110222 | A1 * | 4/2017 | Liptak | H01B 7/1875 |
| 2018/0375232 | A1 | 12/2018 | Wu et al. | |

* cited by examiner

*Primary Examiner* — Ross N Gushi
(74) *Attorney, Agent, or Firm* — Ming Chieh Chang; Wei Te Chung

(57) ABSTRACT

A cable connector assembly includes: an electrical connector including a plug, a metallic shell disposed outside the plug and the cable, and a middle shell; a cable electrically connected with the electrical connector, the cable including plural core wires, an inner shield layer covering the core wires, a metal braided layer covering outside the inner shield layer, and an outer cover layer covering outside the metal braided layer, the metal braided layer including a valgus portion; a case disposed outside the electrical connector and the cable; and a metal inner ring sleeved between the metal braid layer and the outer cover layer, the metal inner ring being electrically connected to the metallic shell through the valgus portion.

11 Claims, 5 Drawing Sheets

CABLE CONNECTOR ASSEMBLY AND ASSEMBLING METHOD OF THE SAME

BACKGROUND OF THE DISCLOSURE

1. Field of the Disclosure

The present disclosure relates to a cable connector assembly and assembling method of the same, in particular to a cable connector assembly and assembling method of the same with improved high-frequency performance and anti-electromagnetic interference.

2. Description of Related Arts

U.S. Pat. No. 7,371,118 discloses a cable connector which includes an electrical connector, a cable electrically connected to the electrical connector, and a case disposed outside the electrical connector and the cable. The electrical connector includes an insulative housing, a plurality of conductive terminals received in the insulative housing, and a metallic shell disposed outside the insulative housing. The cable includes a plurality of core wires and an insulative layer covering the outside of the core wires. The core wires are electrically connected to the corresponding conductive terminals. The rear end of the metallic shell is riveted on the insulative layer of the cable. The cable connector assembly has poor anti-electromagnetic interference and high-frequency performance, and it is difficult to transmit signals above 8 Gb/s.

Therefore, an improved cable connector assembly is desired.

SUMMARY OF THE DISCLOSURE

Accordingly, an object of the present disclosure is to provide a cable connector assembly with good resistance to electromagnetic interference and high frequency performance to transmit high-speed signals.

To achieve the above object, a cable connector assembly comprises: an electrical connector including a plug, a metallic shell disposed outside the plug and the cable, and a middle shell; a cable electrically connected with the electrical connector, the cable including a plurality of core wires, an inner shield layer covering the core wires, a metal braided layer covering outside the inner shield layer, and an outer cover layer covering outside the metal braided layer, the metal braided layer including a valgus portion; a case disposed outside the electrical connector and the cable; and a metal inner ring sleeved between the metal braid layer and the outer cover layer, the metal inner ring being electrically connected to the metallic shell through the valgus portion.

Other objects, advantages and novel features of the disclosure will become more apparent from the following detailed description when taken in conjunction with the accompanying drawings.

DETAILED DESCRIPTION OF THE PREFERRED EMBODIMENT

Reference will now be made in detail to the embodiments of the present disclosure.

Figure 1:
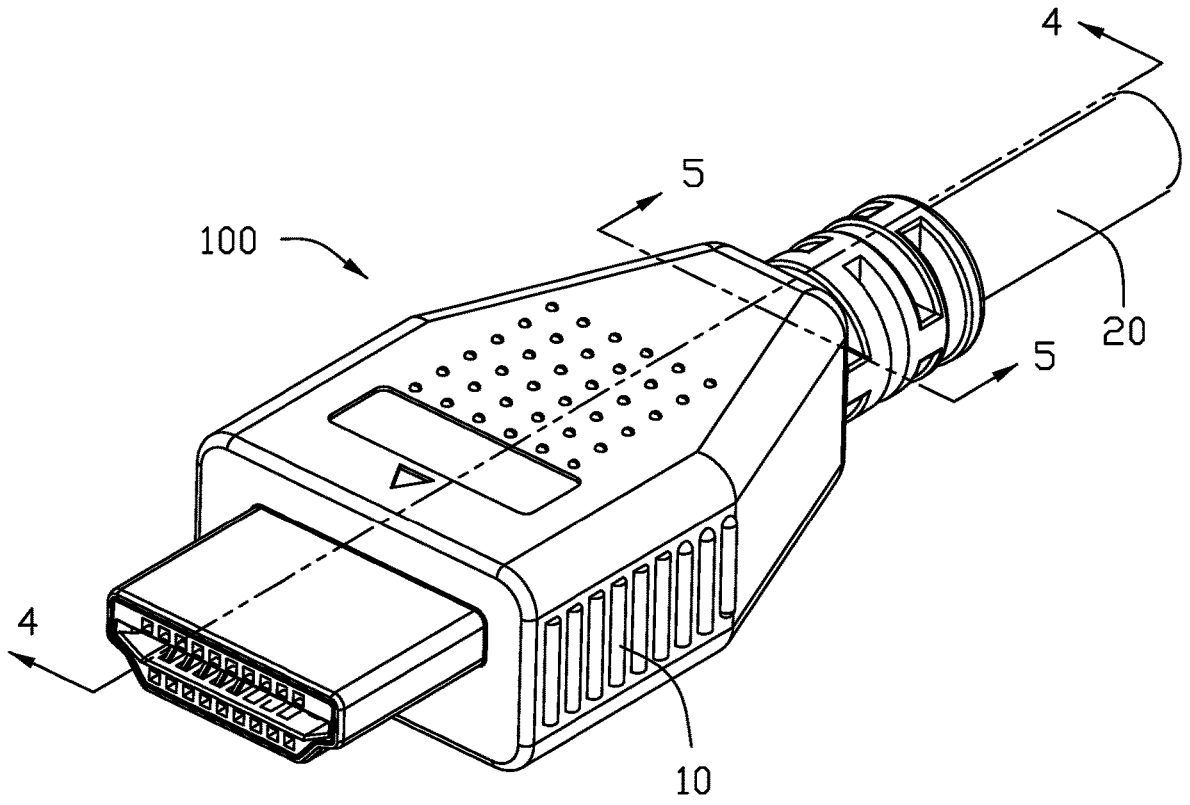
FIG. 1 is a perspective view of a cable connector assembly according to the present invention.
Figure 2:
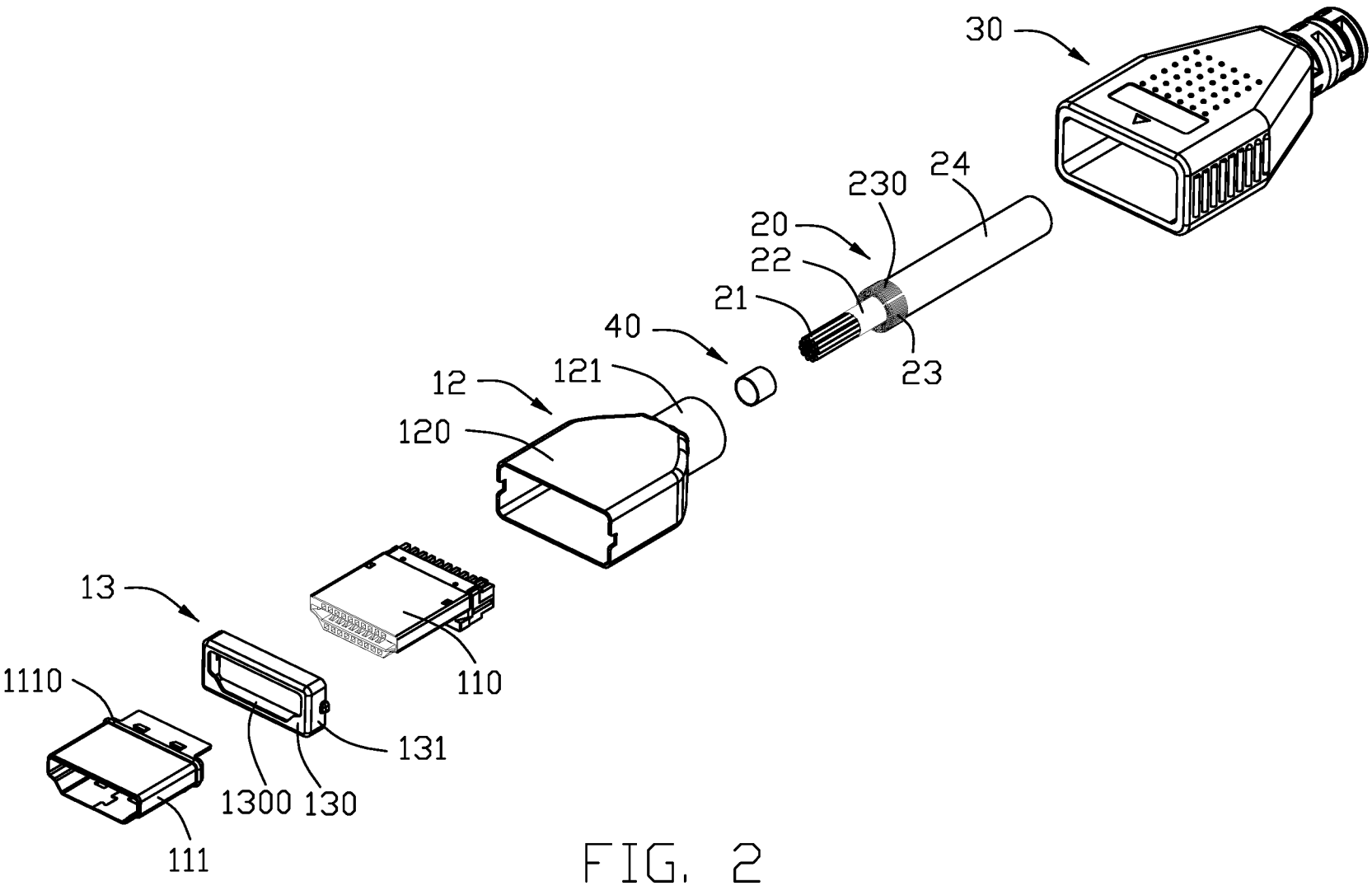
FIG. 2 is an exploded view of the cable connector assembly as shown in FIG. 1.
Figure 3:
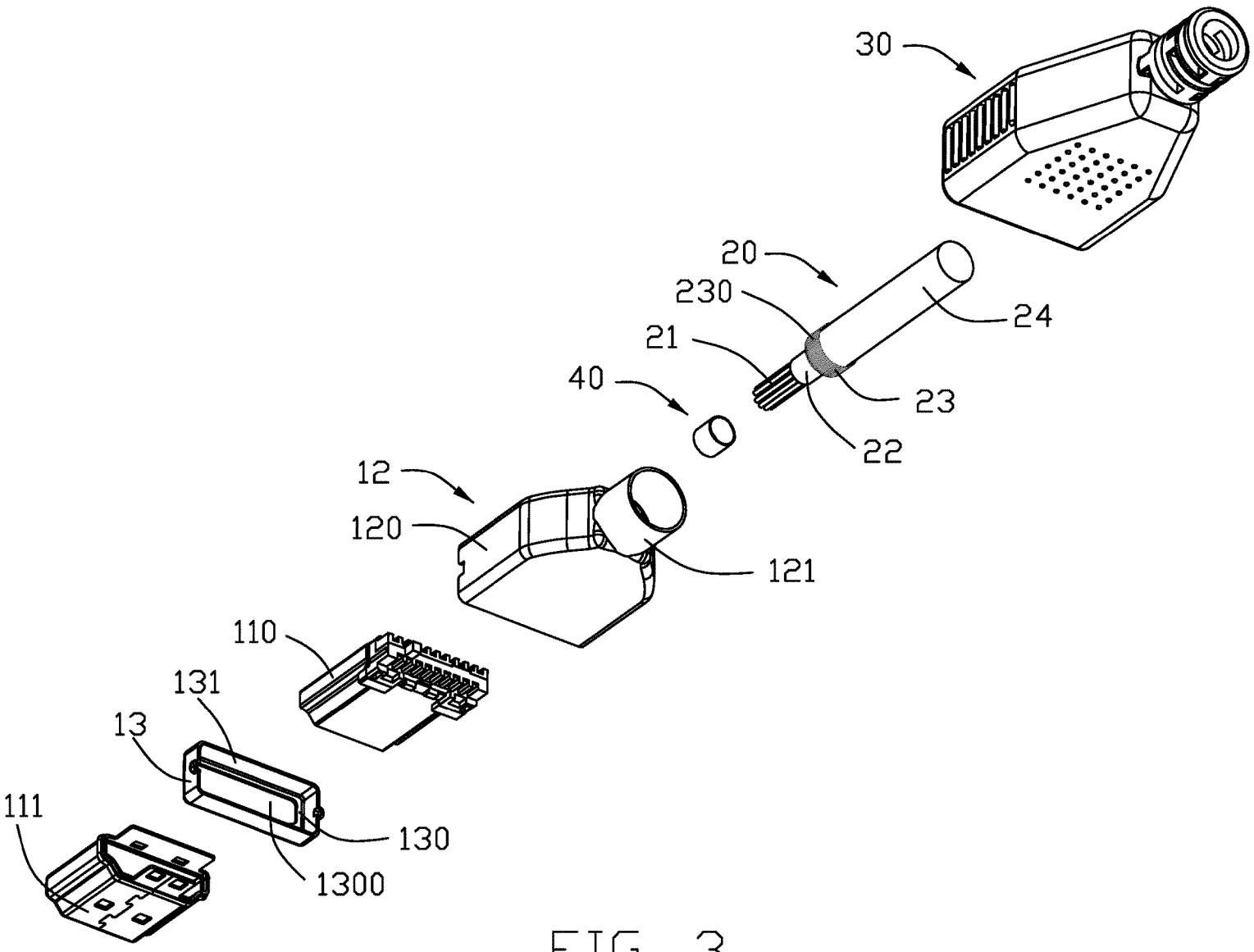
FIG. 3 is another exploded view of the cable connector assembly as shown in FIG. 2.
Figure 4:
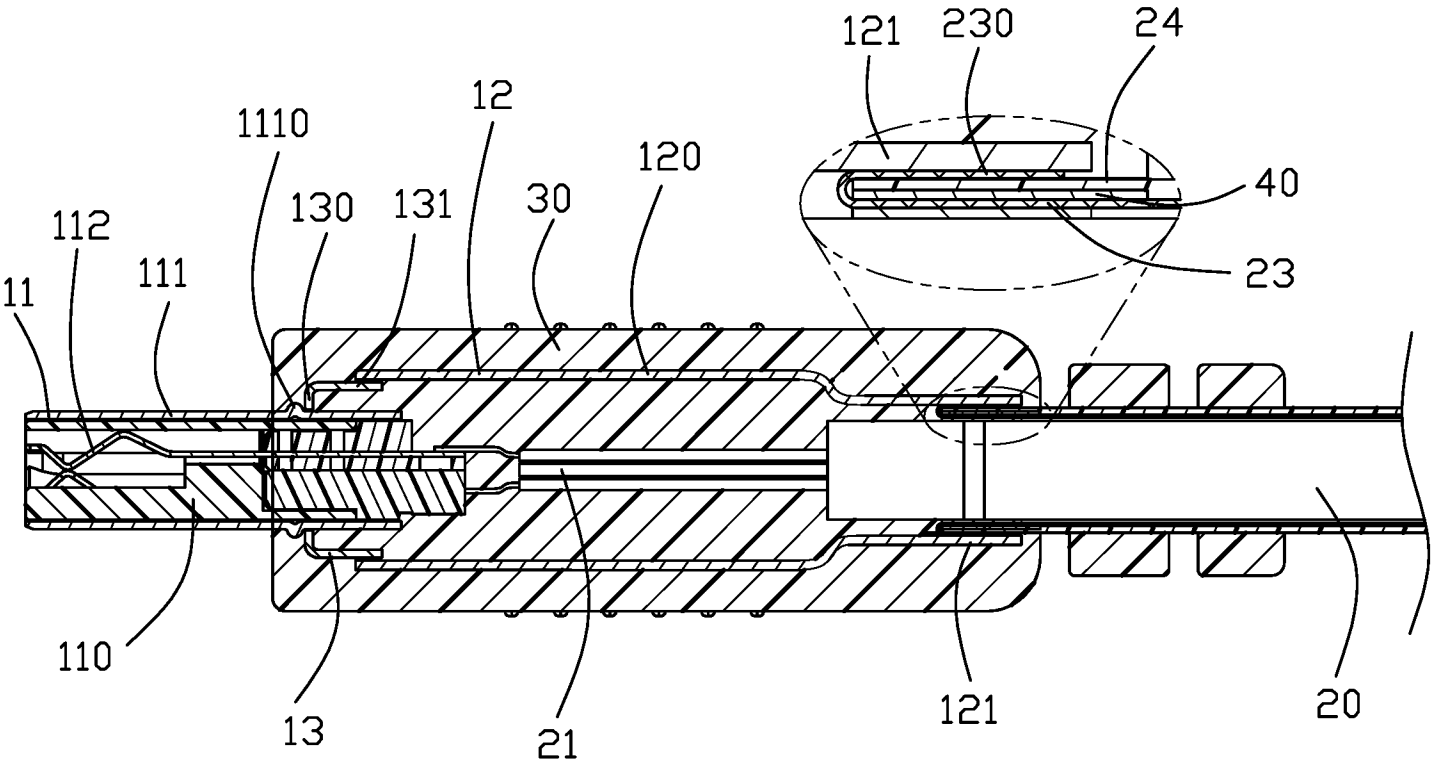
FIG. 4 is a cross-sectional view of the cable connector assembly taken along line 4-4 in FIG. 1.
Figure 5:
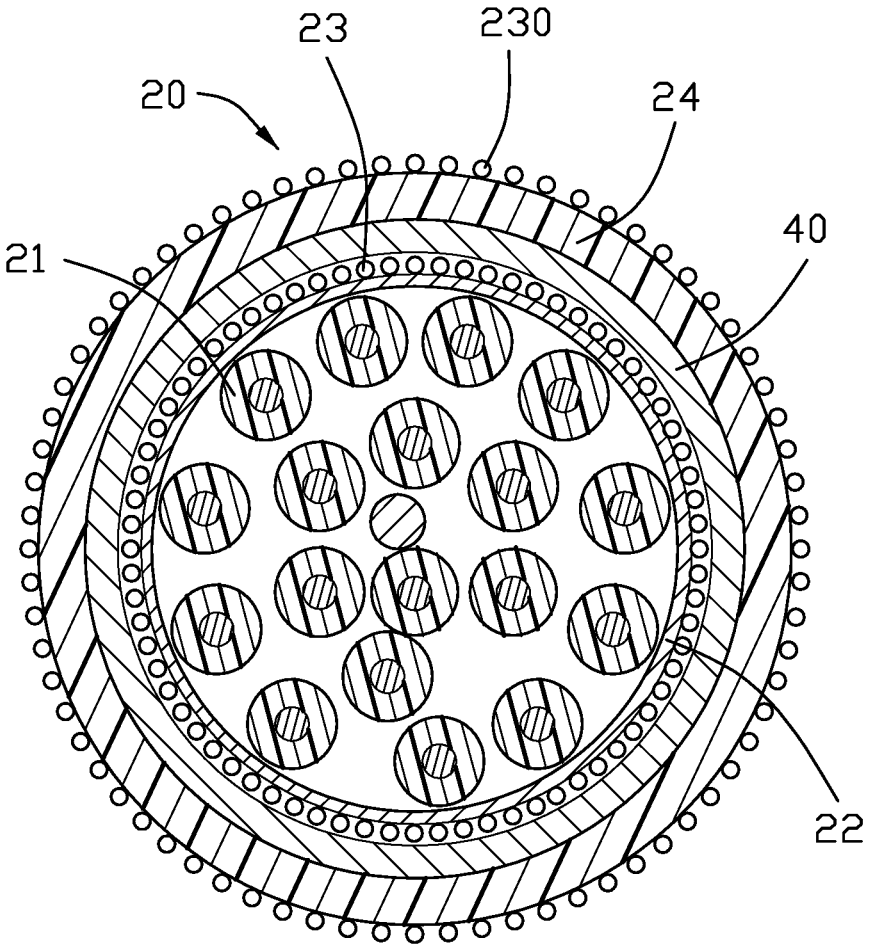
FIG. 5 is a cross-sectional view of a cable of the cable connector assembly taken along line 5-5 in FIG. 1.

Referring to FIGS. 1-5, a HDMI cable connector assembly 100 according to the present invention includes an electrical connector 10, a cable 20 electrically connected with the electrical connector 10, a case 30 disposed outside the electrical connector 10 and the cable 20. The electrical connector 10 includes a plug 11, a metallic shell 12 disposed outside the plug 11 and the cable 20, and a middle shell 13. The cable 20 includes a plurality of core wires 21, an inner shield layer 22 covering the core wires 21, a metal braided layer 23 covering outside the inner shield layer 22, and an outer cover layer 24 covering outside the metal braided layer 23. The metal braided layer 23 includes a valgus portion or backward folded portion 230 that is turned out to the outside of the metal braided layer 23. The HDMI cable connector assembly 100 further includes a metal inner ring 40 sleeved between the metal braid layer 23 and the outer cover layer 24. The metallic shell 12 is electrically connected to the metal inner ring 40 through the valgus portion 230. The metal inner ring 40 has a closed periphery.

The plug 11 includes an insulative housing 110 with a mating port in forward communication with an exterior, a metallic casing 111 disposed outer the insulative housing 110, a plurality of conductor terminals 112 received in the insulative housing 110. The conductive terminals 112 are directly soldered with the corresponding core wires 21 to achieve electrical connection. The conductive terminals 112 and the corresponding core wires 21 can also be electrically connected directly or indirectly through a transfer circuit board or other connection methods. The metallic casing 111 is made by stamping a metal strip. The metallic casing 111 includes a position-limiting protrusion 1110 on the outer side of the metallic casing 111, and the position-limiting protrusion 1110 is arranged around the entire outer side of the metallic casing 111.

The metallic shell 12 is a closed structure formed by a drawing process and includes a main body 120, a shrunk tail portion 121 connected with the main body 120. The tail portion 121 is sleeved on the valgus portion 230 of the metal braid layer 23 of the cable 20. The tail portion 121 is riveted with the valgus portion 230 of the metal braided layer 23. Therefore, the metallic shell 12 establishes an electrical connection with the metal inner ring 40 and the inner shielding layer 22 through the valgus portion 230.

The middle shell 13 is disposed between the metallic casing 111 and the metallic shell 12. The front end of the middle shell 13 is sleeved on the outer side of the metallic casing 111, the front end of the metallic shell 12 is sleeved on the outside of the middle shell 13. The middle shell 13 includes a front wall 130 and a peripherally closed side wall 131 extending rearwardly from the front wall 130. The front wall 130 is provided with a through hole 1300. The middle shell 13 is sleeved on the outer side of the metallic casing 111 through the through hole 1300, and the mating position of the middle shell 13 and the metallic casing 111 is defined by the limiting protrusion 1110.

The outer casing 30 is integrally formed on the outside of the electrical connector 10 and the cable 20. The plug 11 extends forward beyond the housing 110 for mating with the mating connector.

The assembling method of the HDMI cable connector assembly 100 includes the following steps:

Providing a metallic shell 12;

Providing a cable 20, the metallic shell 12 is sleeved on the outside of the outer cover layer 24 of the cable 20, and removing a section of the outer cover layer 24 to expose a section of the metal braid layer 23, the exposed section of the metal braid layer 23 is turned over to the outside of the outer cover layer 24 to form a valgus portion 230;

Providing an insulative housing 110 with a plurality of conductive terminals 112 and electrically connecting the core wires 21 with the corresponding conductive terminals 112;

Providing a metallic casing 111;

Providing a middle shell 13, the middle shell 13 is sleeved on the metallic casing 111 in a back-to-front direction, and the limiting protrusion 1110 on the metallic casing 111 will limit the mating depth of the middle shell 13, then mounting the metallic casing 111 and the middle shell 13 together on the insulative housing 110 along the front-to-back direction, the middle shell 13 is disposed between the metallic casing 111 and the metallic shell 12;

Further providing a metal inner ring 40 sleeved between the metal braid layer 23 and the outer cover layer 24, the metallic shell 12 is electrically connected to the metal inner ring 40 through the valgus portion 230.

The front end of the middle shell 13 is sleeved on the outside of the metallic casing 111, and the front end of the metallic shell 12 is sleeved on the outside of the middle shell 13.

The HDMI cable connector assembly 100 of the present invention further adds a metal inner ring 40 sleeved between the metal braid layer 23 and the outer cover layer 24. The metallic casing 12 is electrically connected to the metal inner ring 40 through the valgus portion 230 to get better anti-electromagnetic interference and high-frequency performance, and transmit high-speed signals of 8 Gb/s, 10 Gb/s, 12 Gb/s or even higher. Notably, in the embodiment, the metal casing 111, the middle shell 13 and the metal shell 12 are all mechanically and electrically connected together as a metallic cover/subassembly shielding the housing 110 and the exposed wires 21. The metal inner ring 40 is located at the rear end of such a metallic shell subassembly so as to form a cross-sectional arrangement in a plane taken at the metal inner ring 40 and perpendicular to the axial direction of the cable 20 that the core wires 21, an optimal inner shield layer 22, the metal braid layer 23, the metal inner ring 40, the insulative outer cover layer 24, the backward folded portion 230 and a shrunk portion 121 of such a metallic shell subassembly concentrically outwardly in sequence. Notably, the insulative case 30 is over-molded upon such a metallic shell subassembly except the metal shell 12 so as to cover the shrunk tail portion 121 wherein rear ends of the shrunk tail portion 121 and the backward folded portion 230 of the metal braid layer 230 are covered, along the axial direction, by the insulative case 30.

What is claimed is:

1. A cable connector assembly comprising:

an electrical connector including a plug, a metallic shell disposed outside the plug, and a middle shell;

a cable electrically connected with the electrical connector, the cable including a plurality of core wires, an inner shield layer covering the core wires, a metal braided layer covering outside the inner shield layer, and an outer cover layer covering outside the metal braided layer, the metal braided layer including a valgus portion;

a case disposed outside the electrical connector and the cable; and a metal inner ring sleeved between the metal braided layer and the outer cover layer, the metal inner ring being electrically connected to the metallic shell through the valgus portion; wherein the plug includes an insulative housing, a metallic casing disposed outer the insulative housing, and a plurality of conductor terminals received in the insulative housing;

the metallic shell includes a main body and a tail portion connected with the main body and sleeved on the valgus portion of the metal braided layer of the cable; and the middle shell is disposed between the metallic casing and the metallic shell.

2. The cable connector assembly as claimed in claim 1, wherein the metallic shell is a closed structure formed by a drawing process.

3. The cable connector assembly as claimed in claim 1, wherein the front end of the middle shell is sleeved on the outside of the metallic casing, and the front end of the metallic shell is sleeved on the outside of the middle shell.

4. The cable connector assembly as claimed in claim 3, wherein the middle shell includes a front wall and a peripherally closed side wall extending rearwardly from the front wall, the front wall is provided with a through hole, and the middle shell is sleeved on the outer side of the metallic casing through the through hole.

5. The cable connector assembly as claimed in claim 4, wherein the metallic casing includes a limiting protrusion, and a mating position of the middle shell and the metallic casing is defined by the limiting protrusion.

6. A method of assembling a cable connector assembly, comprising the steps of:

providing a metallic shell;

providing a cable including a plurality of core wires, an inner shield layer covering the core wires, a metal braided layer covering outside the inner shield layer, and an outer cover layer covering outside the metal braided layer, the metallic shell being sleeved on the outside of the outer cover layer of the cable, and removing a section of the outer cover layer to expose a section of the metal braid layer, the exposed section of the metal braid layer being turned over to the outside of the outer cover layer to form a valgus portion;

providing an insulative housing with a plurality of conductive terminals and electrically connecting the core wires with corresponding conductive terminals;

providing a metallic casing; and providing a middle shell sleeved on the metallic casing in a back-to-front direction, and then mounting the metallic casing and the middle shell together on the insulative housing along the front-to-back direction, the middle shell being disposed between the metallic casing and the metallic shell; characterized by providing a metal inner ring sleeved between the metal braid layer and the outer cover layer, the metal inner ring being electrically connected to the metallic shell through the valgus portion.

7. The method as claimed in claim 6, wherein the front end of the middle shell is sleeved on the outside of the metallic casing, and the front end of the metallic shell is sleeved on the outside of the middle shell.

8. An electrical connector assembly comprising:

an insulative housing with a mating port in forward communication with an exterior;

a plurality of terminals disposed in the housing;

a round cable including a plurality of core wires, a metal braided layer and an insulative outer cover layer with exposed front portions of said core wires respectively connected to the corresponding terminals, and with a metal inner ring located coaxially behind the exposed front portions of said core wires and between the metal braided layer and the insulative outer cover; and a metallic shell subassembly enclosing both the housing and a front segment of the cable with a shrunk tail portion abutting against a backward folded portion of the metal braided layer; wherein a cross-sectional arrangement, taken along a plane at the metal inner ring perpendicular to an axial direction of the cable, includes said plurality of core wires, the metal braided layer, the metal inner ring, the insulative outer cover, the backward folded portion of the metal braided layer and the shrunk tail portion concentrically from an inner side to an outer side.

9. The electrical connector assembly as claimed in claim 8, wherein an insulative outer case is over-molded upon the metal shell subassembly.

10. The electrical connector assembly as claimed in claim 9, wherein both the shrunk tail portion of the metallic shell subassembly and the backward folded portion of the metal braided layer are rearwardly hidden behind the insulative outer cover along the axial direction.

11. The electrical connector assembly as claimed in claim 8, wherein said cable further includes an inner shielding layer between the metal braided layer and the core wires concentrically.

* * * * *